United States Patent [19]

Riecker et al.

[11] 4,233,118

[45] Nov. 11, 1980

[54] EQUIPMENT FOR COLLECTING, EXTRACTING AND PURIFYING FOUL GASES ARISING ON THE COKE SIDE OF A BATTERY OF CHAMBER COKE-OVENS WITH VERTICAL FLUE

[75] Inventors: Johann G. Riecker, Ratingen; Horst Schröter, Viersen, both of Fed. Rep. of Germany

[73] Assignee: Hartung, Kuhn & Co. Maschinenfabrik GmbH, Dusseldorf, Fed. Rep. of Germany

[21] Appl. No.: 2,964

[22] Filed: Jan. 12, 1979

[51] Int. Cl.[2] ..... C10B 33/00; C10B 39/14; C10B 45/00

[52] U.S. Cl. ..... 202/230; 98/115 VM; 105/157 R; 105/254

[58] Field of Search ..... 98/115 VM; 202/227, 202/230, 263; 105/157 R, 161, 254

[56] References Cited

U.S. PATENT DOCUMENTS

| | | | |
|---|---|---|---|
| 783,463 | 2/1905 | Reed | 105/162 |
| 3,801,473 | 4/1974 | Schoen et al. | 202/263 |
| 3,809,622 | 5/1974 | Knappstein et al. | 202/263 |
| 3,839,161 | 10/1974 | Pries | 202/263 |
| 3,844,900 | 10/1974 | Schulte | 202/263 X |
| 3,951,751 | 4/1976 | Jakimonicz et al. | 202/263 |
| 4,087,333 | 5/1978 | Naevestad | 202/263 X |
| 4,113,572 | 9/1978 | Manda et al. | 202/263 X |
| 4,133,721 | 1/1979 | Naevestad | 202/263 |
| 4,141,796 | 2/1979 | Clark et al. | 202/263 X |

*Primary Examiner*—Frank W. Lutter
*Assistant Examiner*—Roger F. Phillips
*Attorney, Agent, or Firm*—Dressler, Goldsmith, Shore, Sutker & Milnamow, Ltd.

[57] ABSTRACT

An improvement is provided for equipment for collecting, extracting and purifying gases arising on the coke side of a battery of coke oven chambers with vertical heating flues in which a triangular frame is provided for carrying the hood which overhangs the loading area of the quench truck and which is movable alongside the oven chambers. The triangular frame is supported at each corner by wheel assemblies. One wheel assembly is mounted for movement along the gas gallery track which also supports the coke batch conveying truck and the other two wheel assemblies are mounted on a track on top of the gas collection duct running alongside the coke oven chambers. A sealing flap is provided to automatically seal the coke batch guide to the hood when the guide is in contact with an oven chamber.

8 Claims, 10 Drawing Figures

EQUIPMENT FOR COLLECTING, EXTRACTING AND PURIFYING FOUL GASES ARISING ON THE COKE SIDE OF A BATTERY OF CHAMBER COKE-OVENS WITH VERTICAL FLUE

TECHNICAL FIELD

The invention relates to equipment for collecting, extracting and purifying foul gases arising on the coke side of a battery of coke oven chambers with vertical flue. Typically, such equipment includes a coke batch-conveying truck having a door-lifting and cleaning device as well as a coke batch guide which is movable on the truck, in the longitudinal and transverse directions thereof, parallel to the oven chambers; a quench train, composed of a locomotive and a quench truck; and a hood overhanging the loading area of the quench truck, all of which can be shifted along the coke side of the battery of coke oven chambers, the hood being connected to a gas transfer device mounted on a gas collection duct which is arranged parallel to the chambers and is connected to a stationary extracting and purifying device. The gas collection device is provided on the top with a longitudinally extending opening which can be covered by an elastic cover belt which can be lifted off the opening of the collection duct by means of the gas transfer device in order to transfer the foul gases into the gas collection duct.

BACKGROUND ART

In known equipment, very voluminous hoods are used in general, the large weight of which requires extraordinarily strong carrier frames which, for this reason, frequently are arranged to be movable only on the quench truck track or on a special track laid at the height of the quench truck track and which, in view of the large weight of the carrier frame and the hood, necessitate their own special drives, support of the carrier frame always being necessary at four different points on the movement rails due to the large weight of hood and carrier frame. Furthermore, in known equipment, there is considerable expense on sealing the outlet end of the coke batch guide, projecting into a receiver opening of the hood. The large weight of hood and carrier frame makes it necessary to employ powerful drive devices in order to be able to conform to the prescribed cycle times for operating the coke-oven battery, in spite of the considerable masses to be accelerated and to be retarded. As a result of all these measures, there is considerable doubt whether such equipment is economical.

BRIEF SUMMARY OF THE INVENTION

It is therefore an object of the invention to improve equipment of the initially mentioned known generic type in such a way that the resulting construction of the equipment is as simple and light-weight as possible, whilst retaining its full efficiency for eliminating the foul gases arising on the coke side of a coke-oven battery.

According to the invention, this object is achieved when a frame which carries the hood and extends substantially horizontally is supported at three points by means of wheels, one support point being provided on a rail on the gas gallery and the other two support points being provided on a track laid on the gas-collection duct which is designed to be self-supporting.

Since the hood and its carrier frame with three-point seating extend substantially horizontally, a very light-weight construction is possible. As a result, a special drive for the frame carrying the hood can be omitted.

It is particularly advantageous to make the distance of the support point of the hood carrier frame on the gas gallery from the line joining the two support points of the hood carrier frame on the gas-collection duct smaller than the distance between the two support points of the hood carrier frame on the gas-collection duct. Due to this geometrical arrangement of the hood carrier frame, only relatively small torsional moments are exerted on the latter, if the drive forces for moving the hood act on one support point of the hood carrier frame, supported on the gas gallery.

With this arrangement of the hood carrier frame, it is advisable to give the latter a triangular shape and to design it in such a way that it can be shifted, with its support points supported on the gas gallery, on the rail, facing away from the coke-oven battery, of a track laid on the gas gallery for the coke batch-conveying truck, and can be coupled to the latter. In this way, the movement rail, which is present anyway, for the coke batch-conveying truck can be utilized for the movable support of the hood carrier frame and the drive power installed for already present coke batch-conveying trucks can be utilized for moving the hood carrier frame along the coke-oven battery. However, independently of this, the triangular hood carrier frame can of course be equipped with a special drive motor which is used only as an emergency unit when necessary.

Particularly good guiding of the triangular hood carrier frame can be achieved by means of a four-wheeled link in each case, via which the carrier frame is supported on the track laid on the collection duct. In this way, the effect of the already small torsional forces, when the hood carrier frame is driven, on the track on the gas-collection duct is yet further reduced.

Moreover, an extremely simple automatic seal of the coke batch guide against the hood is achieved by a seal flap which can be moved into its working position, depending on the motion of the coke batch guide.

Advantageously, a seal flap is fixed, pivotably about a vertical axis, on one longitudinal side of the coke batch guide at the pusher opening thereof and is hinged to a carriage, which bears the coke batch guide so that it can be moved, in such a way that, when the coke batch guide is moved between its working position in contact with an oven chamber and a rest position in which it has been shifted away from the oven chamber, the seal flap can be pivoted into a position in which it seals the hood or, respectively, can be pivoted into a rest position in which it faces away from the hood.

The carriage which bears the coke batch guide and is provided with a door hood overhanging the latter, is advantageously arranged so that it can be shifted above the coke batch guide, parallel to the coke-oven battery on a frame of the coke batch-conveying truck. The coke batch guide is here suspended on the carriage so that it can be shifted parallel to the oven chambers of the coke-oven battery. The side of the seal flap, facing the coke-oven battery, is connected to the carriage bearing the coke batch guide via a link rod so that the seal flap, in the working position of the coke batch guide in contact with the opening of the oven chamber, seals, on one side of the coke batch guide, the hood opening which receives the coke outlet opening thereof, the side of the outlet end of the coke batch guide opposite the seal flap being in sealing contact with the rim of the receiver opening of the hood, whilst, in the rest position facing away from the coke-oven battery, the seal flap assumes a position approximately parallel to the longitudinal axis of the coke-oven battery.

In this way, that part of the rim of the receiver opening for the coke batch guide in the hood, which, in the working position in the coke batch guide, is intended to seal the latter against the hood, forms at the same time a stop for limiting the movement of the coke batch guide parallel to the coke-oven battery into a position in alignment opposite an oven chamber. Since the seal flap is arranged, pivotably about a vertical axis, on one side of the outlet end of the coke batch guide and is pivotally joined to the carriage bearing the coke batch guide so that it can move, the seal flap is always taken along in an unchanged position, when the carriage bearing the coke batch guide moves parallel to the coke-oven battery, but it is automatically pivoted into the sealing position against the other vertical rim of the receiver opening in the hood when the coke batch guide moves transversely to the longitudinal axis of the coke-oven battery towards an oven chamber opening. Whilst the main part of the hood has the shape of a profiled lid, that part of the hood which projects upwards and contains the receiver opening for the outlet end of the coke batch guide, consists of a superstructure which, viewed in plan, is substantially tubular and is connected, outside the triangular hood carrier frame, to the carrier frame in the zone of one front end of the hood. In this way, it is possible to use commercially available tube sections for the upward-projecting part of the superstructure of the hood so that a further simplification and cost reduction is achieved.

Advantageously, the receiver opening of the hood for the coke batch guide assumes a distance from the vertical cylinder axis, which exceeds the radius of the tubular part of the superstructure of the hood, the clear width of the hood increasingly widening from the receiver opening of the coke batch guide up to the cylinder diameter, and the vertical rim, which faces away from the nearest end face of the hood, of the receiver opening is set back relative to the rim facing the end face of the hood, and the seal flap in its sealing position bridges the free gap, making a seal, between the coke batch guide and the associated rim of the receiver opening in the hood. In this way, unhindered motion of the coke batch guide in the direction of the other end of the hood, and hence separation of the coke batch guide from the hood, is possible.

The coupling of the seal flap to the carriage bearing the coke batch guide can be designed in such a way that a vertical arm projects downwards from the coke batch guide carriage and the link rod of variable length is hinged, pivotably in a horizontal plane, to the lower end thereof, whilst the other end of the link rod pivotally engages with the rear of the seal flap in the middle of the width thereof.

BRIEF DESCRIPTION OF THE DRAWINGS

The invention is illustrated, by way of example and diagrammatically, in the drawing in which:

In FIG. 1, a coke-oven battery 11 can be seen, having an oven chamber 12 and, on the coke side, a gas gallery 13 on which a track 14 is laid. A coke batch-conveying truck 15 can be moved parallel to the coke-oven battery on the track 14 and is equipped with a coke batch guide 16 which can be moved horizontally by means of pairs of wheels 17 (FIG. 5) in U-profiles 18 of a carriage 19, parallel to the axis of the oven chamber 12. The carriage 19 is in turn arranged so that it can be moved by means of pairs of wheels 20 in profile rails 21, located at a distance from one another, of a frame 22 in the direction of movement of the coke batch-conveying truck 15. The frame 22 thus extends above the coke batch guide and is fixed, outside the range of movement of the carriage 19, on the chassis of the coke batch-conveying truck. Moreover, the coke batch-conveying truck is equipped with a door-lifting and door-cleaning device which is known in itself and is therefore not shown, and, according to FIG. 2, it is covered by a hood 23 which is rigidly joined to the frame 22. The door-lifting device is pivotable between a working position and a rest position in a manner which is in itself known and is therefore not shown, in such a way that the operating controls of the coke batch-conveying truck can function in one and the same position of the latter in a manner which is in itself known.

Figure 1:
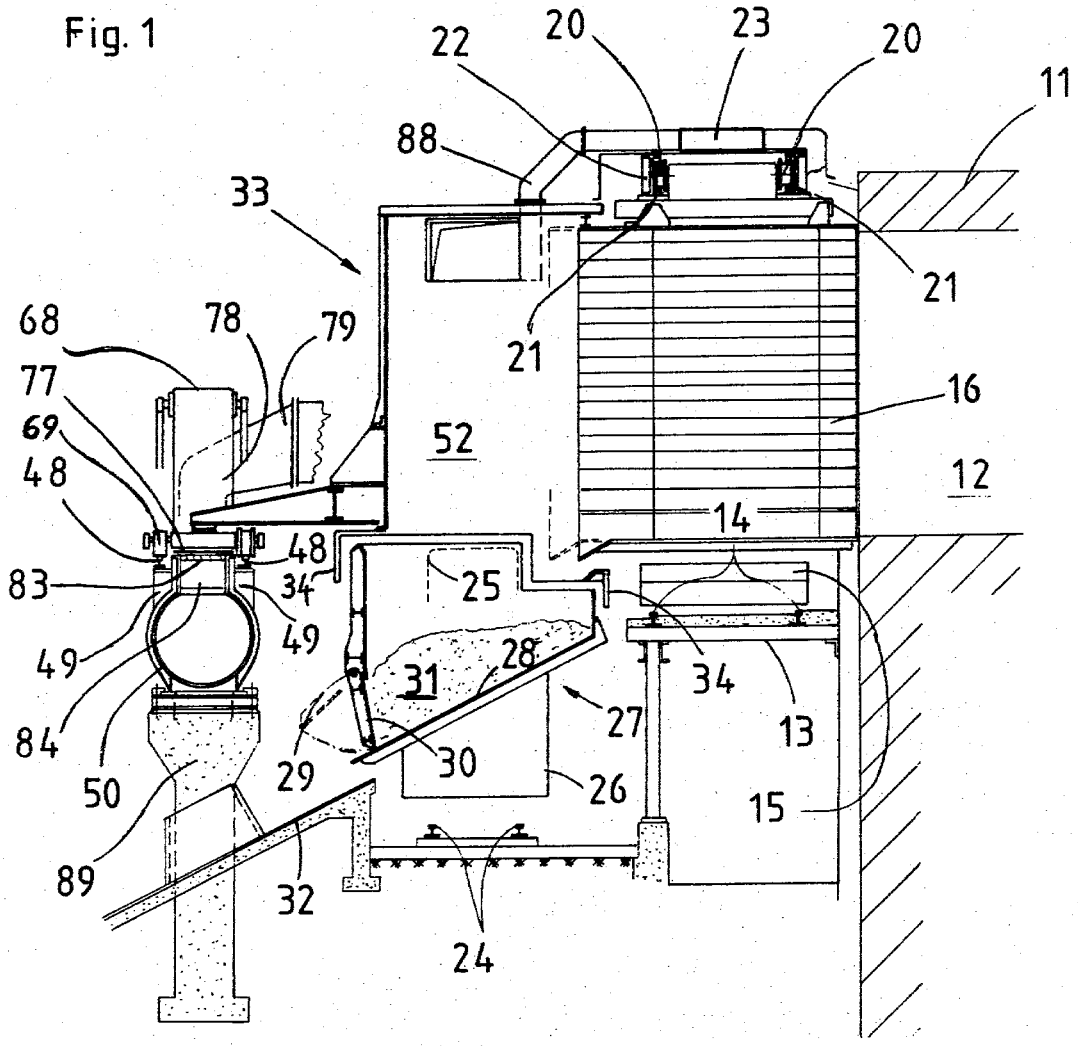
FIG. 1 shows a cross-section through equipment for collecting, extracting and purifying foul gases arising on the coke side of a battery of chamber coke-ovens with vertical flue, along the cut line I—I in FIG. 2.

On the side of the gas gallery 13, facing away from the coke-oven battery, a track 24 for a quench train 27 consisting of a locomotive 25 and a quench truck 26 is laid at ground level, on which track the quench train can be moved parallel to the longitudinal axis of the coke-oven battery. As FIG. 1 shows, the quench truck is provided in a manner which is in itself known with a sloping floor 28 and, on its side, with a discharge flap 30 tilting about a horizontal axis 29 so that the quenched coke 31 can be discharged onto a ramp 32 and can be fed from there to its further intended use.

Figure 2:
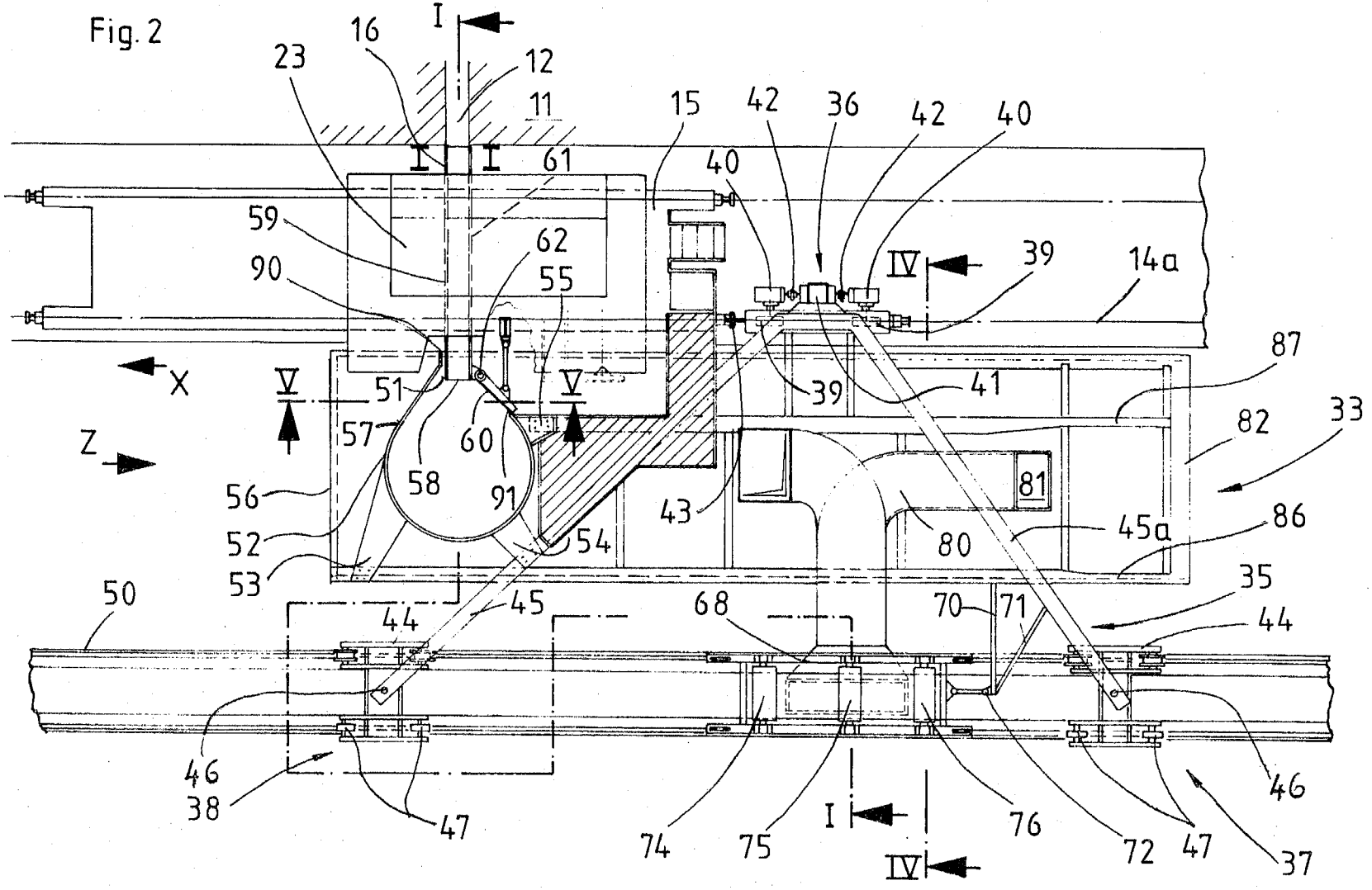
FIG. 2 shows a plan view of the equipment in FIG. 1.

The open-top charge opening of the quench truck 26 is, as FIG. 2 shows, completely covered by a hood 33 which extends substantially horizontally in the form of an angle profile and which, by means of aprons 34 fitted on the longitudinal sides, overhangs the upper longitudinal edges of the quench truck at a relatively small distance.

Figure 9:
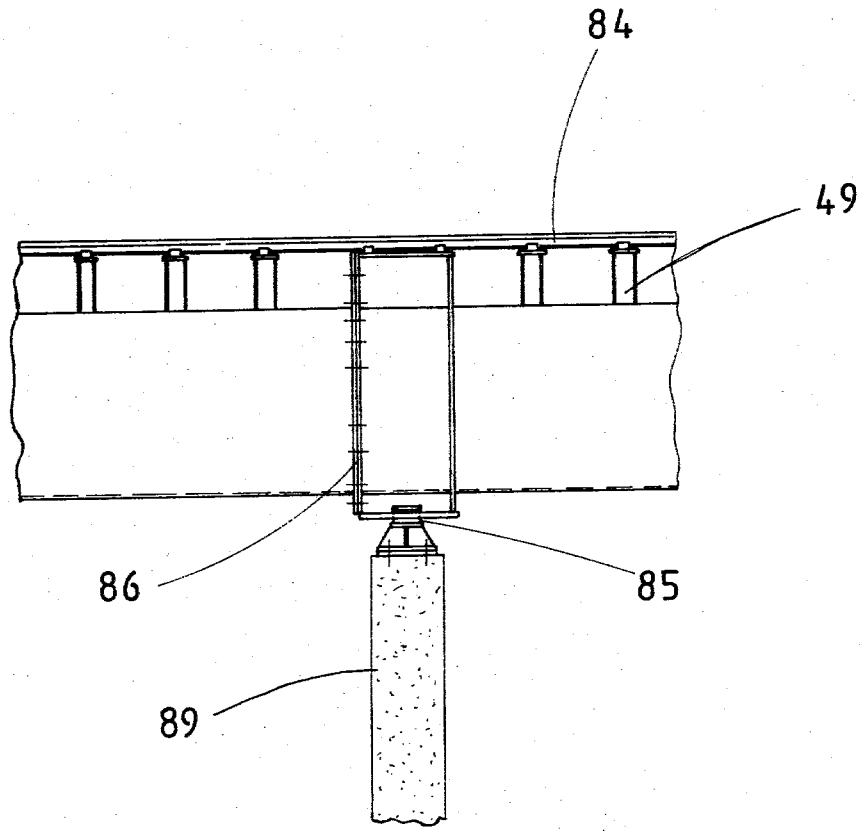
FIG. 9 shows a broken-off enlarged side view of the gas-collection duct with the support in FIG. 3

As FIG. 2 shows, the hood 33 is fixed to a hood carrier frame 35 which has a substantially triangular shape and is supported at three points 36, 37, 38. The support point 36 consists of a two-wheeled link, the track wheels 39 of which are supported so that they can move on the rail **14*a*, facing away from the coke-oven, of the track 14 for the coke batch-conveying truck. The two track wheels 39 are connected via miter gears 40 to a, for example, electric drive motor 41, via couplings 42. This drive unit can be arranged as an emergency unit which normally does not need to be used for moving the hood carrier frame 35. In the region of the sole support point 36 on the gas gallery 13, the carrier frame can be coupled via a coupling 43 to the coke batch-conveying truck 15. The support points 37, 38 of the triangular hood carrier frame 35 each consist of four-wheeled links 44, to the chassis of which the ends of the beams 45, 45***a* forming the legs of the triangular frame 35 are hinged at the pivot points 46. The track wheels 47 of the four-wheel links are supported on a track 48 which is fixed via rail chairs 49 (FIG. 9) to a gas-collection duct 50 which is designed to be self-supporting.

As can be seen from FIG. 2, the distance of the support point 36 on the gas gallery 13 from the line joining the support points 37 and 38 of the hood carrier frame 35 is smaller than the mutual distance of the two support points 37 and 38, the line joining the latter representing the hypotenuse of the triangle formed by the carrier frame. Consequently, the torsion moments and bending moments which arise when tractive forces or thrust forces are exerted on the carrier frame 35, are very small, particularly since the transverse forces exerted on the track 48 are also distributed over the four-wheeled links 44. Parallel to the gas-collection duct 50, two parallel longitudinal beams 86, 87 which are spaced from one another and are likewise joined to the hood, are fixed to the beams 45 forming the legs of the triangular carrier frame 35. Whilst the hood 33 thus extends substantially in the horizontal direction, it has, in the region of its receiver opening 51 for the coke batch guide 16, a superstructure component 52, extending tubularly upwards, which can thus be assembled from prefabricated tube sections. This tubular superstructure 52 is rigidly fixed via struts 53 to the beam 86 and via struts 54 to the beam 45 forming a leg of the triangle and, finally, via struts 55 to the longitudinally disposed beam 87 and, furthermore, it is fixed to one end of the hood 33 outside the triangular carrier frame 35.

Figure 7:
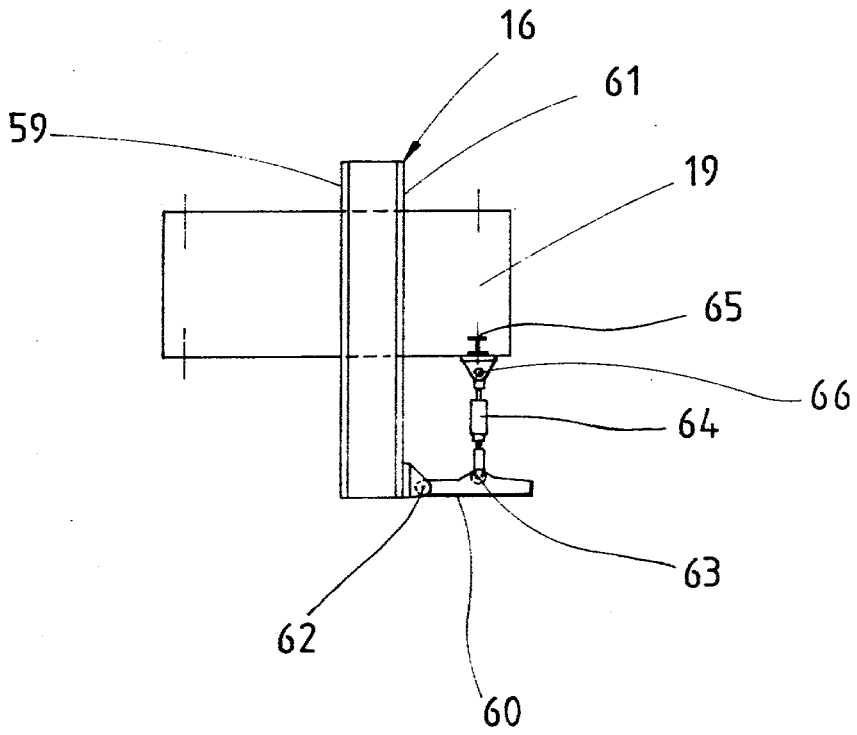
FIG. 7 shows a section along the cut line VII—VII in FIG. 5.
Figure 8:
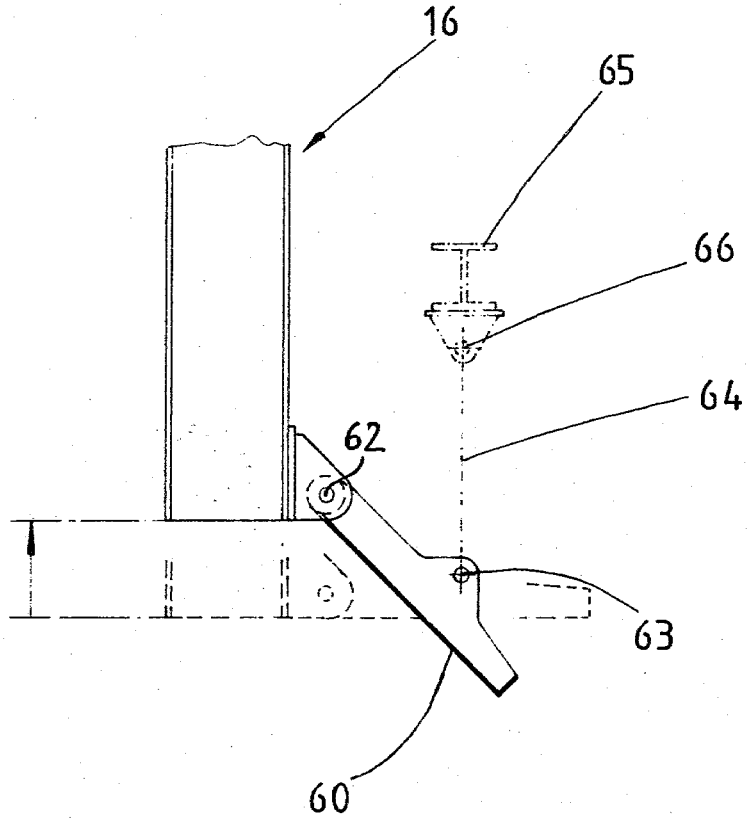
FIG. 8 shows the coke batch guide and the sealing plate, each in the working position.

As FIG. 2 shows, the horizontal cross-section of the tubular superstructure component 52 has the shape of a bulb or drop pointing to its receiver opening 51 so that the receiver opening 51 is located at a radial distance, which exceeds the radius of the tube section, from the vertical central axis of tubular superstructure component 52. The side 57 of the superstructure component 52, located nearest the end face 56 of the hood 33, here extends continuously up to an opening rim 90 close to the outside of one side wall 59 of the coke batch guide 16 in the direction of movement along the arrow x. The other opening rim 91, facing away from the end face 56 of the hood 33, is considerably set back, relative to the opening rim 90, towards the side facing away from the coke-oven and forms a seal face for a seal flap 60 which is placed against the side wall 61 of the coke batch guide 16, facing away from the nearest end face 56, and is pivotable about a vertical axis 62 in the region of the outlet opening 58 of the coke batch guide 16. As can best be seen from FIGS. 5 to 8, this seal flap 60 is pivotally joined, on its rear in the middle of the width, at a hinge point 63 to a link rod 64 of adjustable length, the other end of which is hinged at 66, pivotably horizontally, to the lower end of an arm 65 fixed to the carriage 22. The distance between the hinge point 66 and the vertical central plane of the coke batch guide 16 is thus constant so that, in the rest position of the coke batch guide 16 shown in FIG. 7, the seal flap 60 assumes a rest position which is approximately parallel to the longitudinal axis of the coke-oven battery, whilst, in the working position of the coke batch guide 16, pushed forward in the direction of an oven chamber, it assumes the angled position which is shown in FIG. 8 and which corresponds to the sealing position, shown in FIG. 2, of the seal flap. It can thus be seen that the seal flap 60 bridges the gap which exists between wall 61 of the coke batch guide and the opening rim 91 of the tubular superstructure component. On the other hand, it can be seen from the rest position of the seal flap, shown in dashes in FIG. 2, that the coke batch guide itself can be displaced unhindered, without shifting the coke batch-conveying truck, in order to free the space in front of the oven chamber, for example for the door-lifting device.

As FIG. 1 shows, the upper part of the hood 33 is connected via connecting line 88 to the hood 23 which overhangs the door-lifting machine and which, in the position in which the coke batch guide is moved up to the oven chamber and which is shown in FIG. 1, is in sealing contact with a coke-oven battery 11 above the oven chamber 12 so that the foul gases which already rise during and after the lifting of an oven door, are collected together with the contaminated gases rising when the red-hot coke batch is pushed by the coke batch guide, and can be extracted through the connecting line 88 into the tubular superstructure component 52 of the hood 33.

Figure 3:
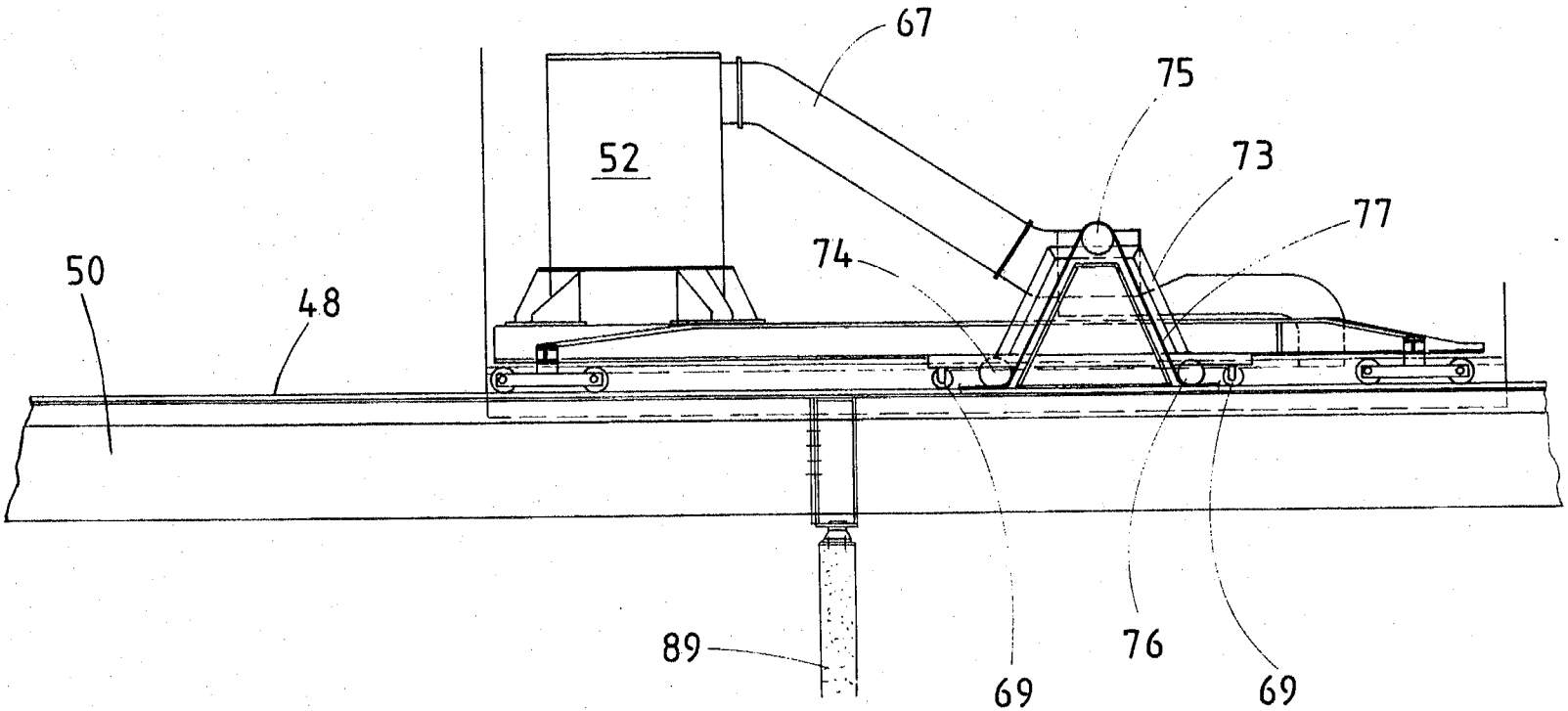
FIG. 3 shows a side view of the gas-collection duct and the hood in FIG. 2.
Figure 10:
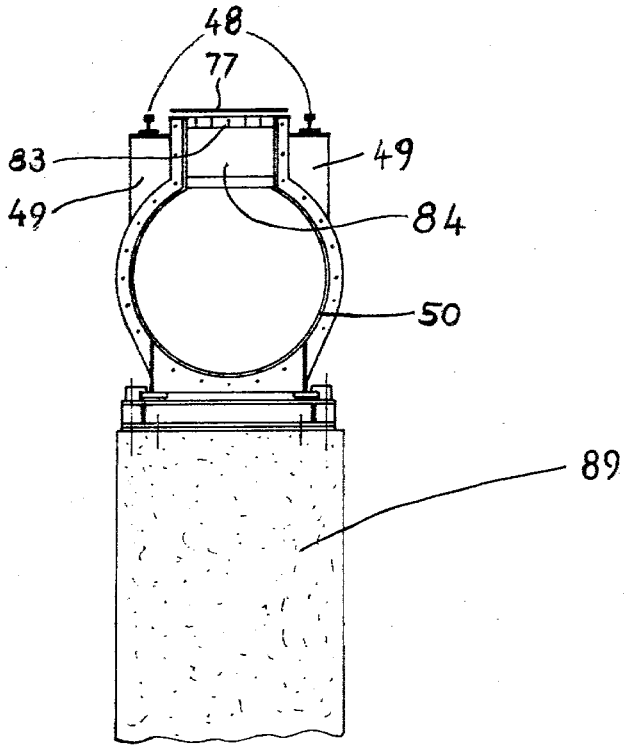
FIG. 10 shows the gas-collection duct according to FIG. 1 in an enlarged cross-section.

The upper part of the tubular superstructure component 52 communicates via an extraction line 67 (FIG. 3) with a gas transfer device 68 (FIG. 2) which can be shifted by means of wheels 69 on the track 48 on the gas collection duct 50. The gas transfer device is releasably coupled at 72 via struts 70, 71 to the triangular hood carrier frame 35, which ensures that the gas transfer device 68 is taken along when the triangular carrier frame 35 is moved. It can be seen that the casing 73 (FIG. 2) of the gas transfer device 68 takes three guide pulleys 74, 75, 76 around which a flexible, heat-resistant rubber belt 77 is guided in such a way that a gas passage orifice 78 (FIG. 1) for a pipe elbow 79 is formed, to which the extraction line 67 is flanged, into which a further extraction line 80 (FIG. 2) leads, which is provided on an extraction opening 81 in the region of the other end face 82 of the hood 33, that is to say in that part of the hood which extends flat in the horizontal direction. The cover belt 77 lies, making a seal, on a grate 83 (FIG. 10) which traverses the open cross-section of an opening 84 extending along the top of the gas-collection duct 50 and thus frees in each case, only in the region of the gas transfer device which thus at the same time represents a belt-lifting device, a passage cross-section of this opening 84 for transferring the foul gases collected by the hood 33 into the gas-collection duct.

Figure 4:
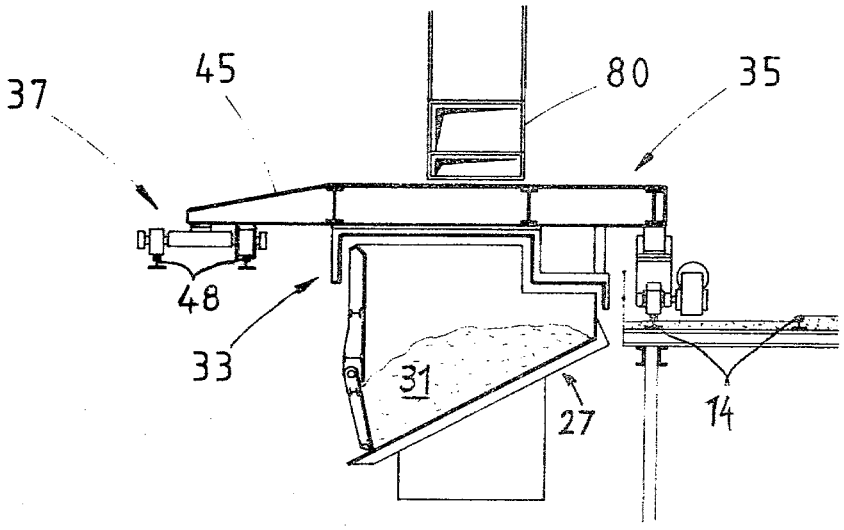
FIG. 4 shows a cross-section of the hood and the quench truck, approximately along the cut line IV—IV in FIG. 2.
Figure 5:
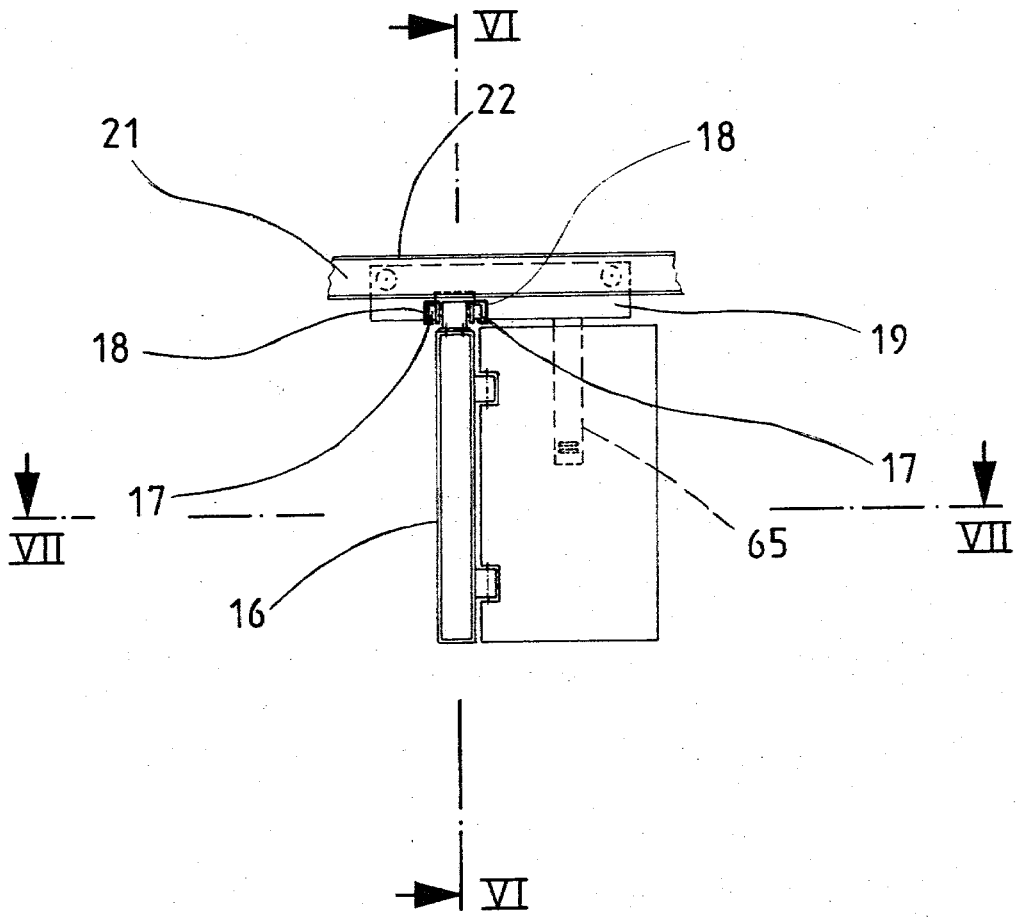
FIG. 5 shows a broken-off diagrammatic side view, approximately according to a cut along the line V—V in FIG. 2.
Figure 6:
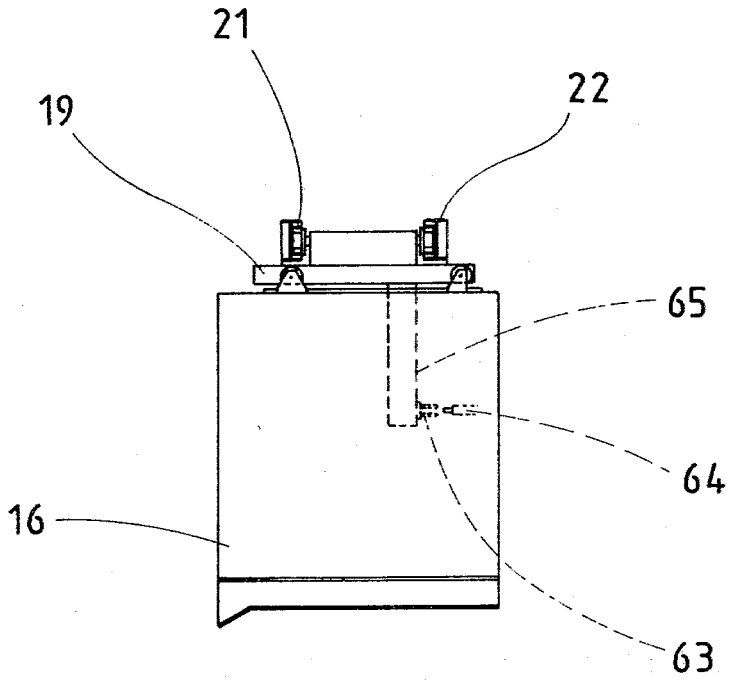
FIG. 6 shows a section along the cut line VI—VI in FIG. 5.

FIG. 4 clearly shows the horizontally extending flat shape of the triangular hood carrier frame 35 with the hood 33 which is fixed to the underside and extends horizontally flat.

FIGS. 1, 3, 9 and 10 show concrete pillars 89 which, at a pitch from one another in the region of the loading ramp, support the gas-collection duct 50 via sliding plates 85 consisting of polytetrafluoroethylene, in a self-supporting design by means of suitable flange connections 86 and the rail supports 49 and a suitable cross-sectional shape.

It can thus be seen that the rails provided for being able to move the coke batch-conveying truck and the gas transfer device are used at the same time for the 3-point support of the triangular hood carrier frame and that no special actuating controls are necessary for additionally sealing the coke batch guide against the tubular superstructure component 52 of the hood since the seal between the coke batch guide and the hood is automatically made by means of the seal flap when the coke batch guide is moved into the working position in front of an oven chamber.

We claim:

1. In equipment for collecting, extracting, and purifying gases arising on the coke side of a battery of coke oven chambers with vertical heating flues, and wherein said equipment includes: gas gallery track means parallel to and alongside said chambers; a coke batch-conveying truck movable on said gas gallery track means alongside said chambers and having a door-lifting and cleaning device and a coke batch guide which is movable on the truck in the directions both parallel and transverse to the movement of said truck alongside said chambers; a quench train having a locomotive and a quench truck movable alongside said chambers; a hood overhanging the loading area of the quench truck and movable alongside said chambers; a stationary gas extracting and purifying device; a gas collection duct arranged parallel to said chambers and connected to said stationary gas extracting and purifying device, said gas collection duct defining a longitudinally extending opening, said opening covered by an elastic cover belt which is liftable from said gas collection duct opening; and a gas transfer device connected to said hood and movable on said gas collection duct under said belt for lifting said belt from said gas collection duct opening thereby effecting transfer of said gases from said hood to said collection duct;

the improvement comprising:

track means on said gas collection duct;

frame means for carrying said hood and extending substantially horizontally, said frame means being supported at three spaced-apart points; and first, second, and third wheel means, one wheel means at each of said three support points for supporting said frame, said first wheel means being mounted for movement along said gas gallery track means and said second and third wheel means being mounted for movement along said gas collection duct track means, the distance of said frame support point on said gas gallery track means from the line joining said other two frame support points on said gas collection duct track means being less than the distance between said other two frame support points on said gas collection duct track means.

2. The apparatus in accordance with claim 1 wherein said frame is of triangular shape and is movable with said support point on said gas gallery track means and further including means for coupling said frame adjacent said support point on said gas gallery track means to said coke batch conveyor truck.

3. The apparatus in accordance with claim 2 wherein said first wheel means includes drive motor means for moving said frame on said gas gallery track means.

4. The apparatus in accordance with claim 1 in which said gas collection duct track means includes two spaced-apart parallel gas collection duct tracks and in which each said second and third wheel means includes a four-wheeled trolley adapted to run on said gas collection duct tracks.

5. The apparatus in accordance with claim 1 in which said coke batch guide has two sides defining a discharge opening therebetween and further including a carriage having coke batch guide tracks supporting said coke batch guide for movement relative to said carriage transversely to said gas gallery track means between a working position in contact with an oven chamber and a rest position spaced away from the oven chamber and further including a seal flap pivotably mounted about a vertical axis on one side of said coke batch guide adjacent the discharge opening thereof and connected to said carriage whereby, when the coke batch guide is located in the working position, said seal flap is pivoted into a working position in which it seals against said hood and when the coke batch guide is located in the rest position, said seal flap is pivoted into a rest position in which it is spaced away from the hood.

6. The apparatus in accordance with claim 5 further including at least one carriage support member extending over said coke batch guide alongside said oven chambers; in which said carriage has a door hood overhanging said coke batch guide; in which said carriage is movable parallel to said ovens on said carriage support member to carry the coke batch guide parallel to said oven chambers; in which said hood has a coke batch guide receiving aperture for receiving said coke batch discharge opening; and in which said seal flap has a first side facing said coke oven chambers connected to said carriage by a link rod whereby, when said coke batch guide is in said working position in contact with the opening of an oven chamber, said seal flap seals the coke batch guide receiving aperture of said hood along one side of the coke batch guide with the side of the coke batch guide opposite the seal flap being in sealing contact with said hood and whereby, when said seal flap is in said rest position, the seal flap assumes a position approximately parallel to the longitudinal axis of the battery of coke oven chambers.

7. The apparatus in accordance with claim 6 wherein a first portion of said hood generally has the shape of a substantially flat cover and wherein a second portion of said hood projects upwardly to define said receiving aperture for the discharge opening of said coke batch guide, said second portion of said hood, when viewed in plan, being substantially tubular, said second portion further being connected to said first portion outside and forward of said frame.

8. The apparatus in accordance with claim 6 further including a vertical arm projecting downwardly from said carriage, said link rod being of variable length with one end of said link rod hinged, pivotably in a horizontal plane, to the lower end of said arm and with the other end of said link rod pivotably engaged with said first side of said seal flap in the middle of the width of the flap.

* * * * *